United States Patent [19]

Czerner et al.

[11] 3,997,968

[45] Dec. 21, 1976

[54] SWITCH ARRANGEMENT FOR HAND-HELD PORTABLE ELECTRICAL APPLIANCES

[75] Inventors: Peter Alfred Czerner, Trumbull; Edward Szymansky, Fairfield, both of Conn.

[73] Assignee: Sperry Rand Corporation, Bridgeport, Conn.

[22] Filed: June 4, 1975

[21] Appl. No.: 583,610

[52] U.S. Cl. ..... 30/43.92; 200/330

[51] Int. Cl.[2] ..... B26B 19/02

[58] Field of Search ..... 30/43.91, 43.92, 43; 200/330, 333, 291

[56] References Cited

UNITED STATES PATENTS

| | | | |
|---|---|---|---|
| 2,639,356 | 5/1953 | Savage | 200/333 X |
| 3,196,541 | 7/1965 | Foley | 30/43.92 |
| 3,328,542 | 6/1967 | Andrews | 30/43.92 X |
| 3,412,463 | 11/1968 | Rundzaitis | 30/43.92 X |

*Primary Examiner*—Gary L. Smith

*Attorney, Agent, or Firm*—Charles R. Miranda

[57] ABSTRACT

An electric power switch arrangement for a hand-held, portable electrical appliance is disclosed which provides improved positive, mechanical switch detenting. A mount for the switch comprises a receptacle having integrally formed fingers for gripping and captivating the switch..

10 Claims, 8 Drawing Figures

Fig. 1.
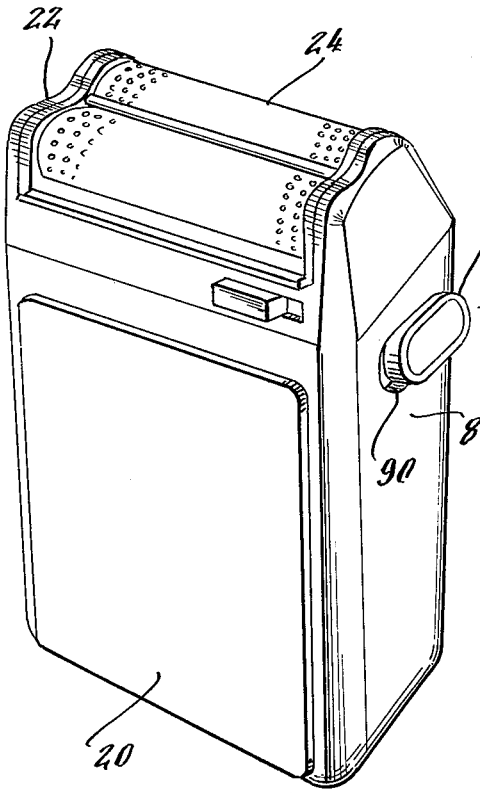
Fig. 7.
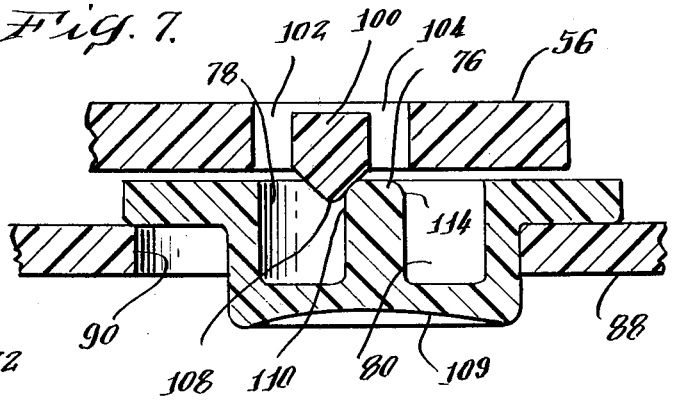
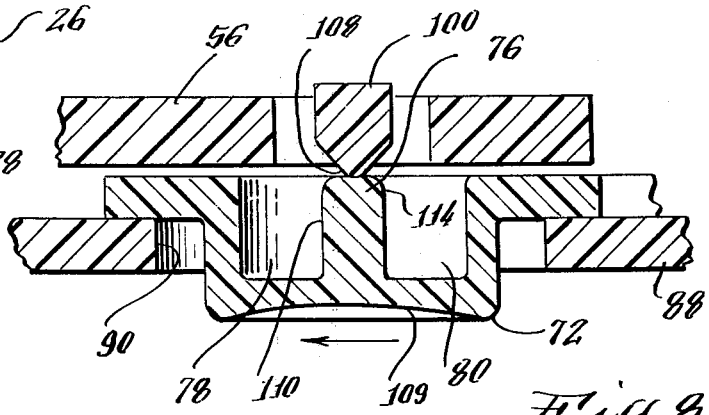
Fig. 8.
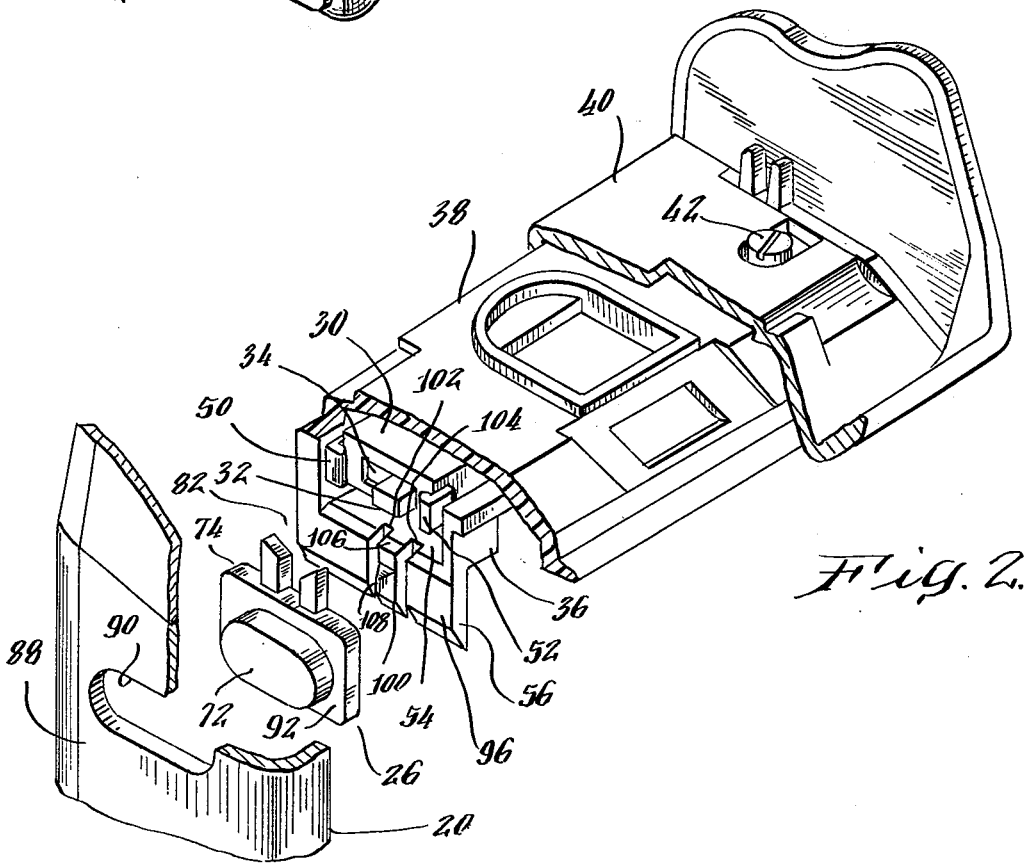
Fig. 2.

SWITCH ARRANGEMENT FOR HAND-HELD PORTABLE ELECTRICAL APPLIANCES

BACKGROUND OF THE INVENTION

This invention relates to new and useful improvements in hand held, portable electrical appliances. The invention relates more particularly to improved switch detent and mounting arrangements for these appliances.

Hand held, portable electric appliances generally include an electric On/Off switch arrangement which enables the user to apply or interrupt the application of electric power to an electric drive means of the appliance. It is preferable for the convenience of the user that the switch exhibit a positive feel in transferring between On/Off positions and for reliability of operation that the switch provide positive, mechanically detented On/Off positions. However, manufacturing cost is an important factor in the fabrication of appliances and the detenting function of the power switch can represent a significant cost factor in the construction of the switch. While switching means having the desired electrical switching characteristics are available at favorable cost factors, these arrangements generally do not exhibit a positive switch detent of desired reliability for use in an appliance.

One form of hand held, portable, electric appliance to which the invention is applicable is an electric dry shaver. In a prior dry shaver electric switching arrangement, a detent enhanced relatively low cost electric switch is mounted within a casing of the shaver. An actuating member of the switch is engaged by a segment of a detent body while another segment of the detent body extends through a aperture of the casing and is positioned for tactile actuation by the user. An enhanced detent is provided by a pair of integral detent body legs which extend adjacent an inner surface of the casing and are spaced for engaging ribs which are integrally formed in the casing and extend from an inner surface of the casing. Although this arrangement provides adequate detenting, it is desirable to provide an enhanced detenting arrangement which is more positive in its action, which is less costly, and which can supply the complete detenting for the switch.

In a prior electric dry shaver, mounting of the switch has been provided by a pocket formed in a two piece motor shroud. The two piece shroud however requires a number of components, is complex in assembling, and is relatively costly.

Accordingly, it is an object of this invention to provide an improved detented switching arrangement for a hand held, portable electric appliance.

Another object is to provide a detented switching arrangement for an electrical dry shaver of reduced complexity and improved reliability and cost.

Another object is to provide an improved switch mounting arrangement in an electrical dry shaver.

SUMMARY OF THE INVENTION

In accordance with a feature of the invention, a hand held, portable electrical appliance comprises an appliance casing having an electric switch mounted within the casing. An aperture is formed in a wall of the casing and a switch actuating detent body engages an actuating member of the switch within the casing and extends through the aperture for tactile actuation of the switch by a user. A resilient means is positioned within the casing in the path of travel of the detent body which interferes with the travel of the detent body. The resilient means is deflectable by the detent body upon the application of a tactile actuating force to the body thus providing first and second detented positions for the switch.

In accordance with another feature of the invention, an electric dry shaver having a casing includes a one piece motor shroud body positioned within the casing. The shroud body includes a surface segment which is positioned adjacent a wall portion of a casing and a switch body receptacle is integrally formed in the shroud. The receptacle extends from an aperture at the shroud surface segment to the interior of the casing and is adapted to receive a switch body which is introduced into the receptacle at the aperture. Resilient means are integrally formed with the shroud for receiving and restraining the switch body in the receptacle.

These and other objects and features of the invention will become apparent with reference to the following specifications and to the drawings.

DESCRIPTION OF THE DRAWINGS

In the drawing:

FIG. 1 is a perspective view of an electric, hand held portable shaving appliance which is constructed in accordance with features of the invention;

FIG. 2 is an enlarged, exploded, fragmentary, perspective view of a cutter head of the shaver appliance of FIG. 1;

FIG. 7 is a fragmentary sectional view taken along lines 7—7 of FIG. 3 and illustrating a detent body in one detent position; and, FIG. 8 is a sectional view illustrating the detent body of FIG. 7 positioned at an intermediate location between first and second detent positions.

DETAILED DESCRIPTION

Figure 3:
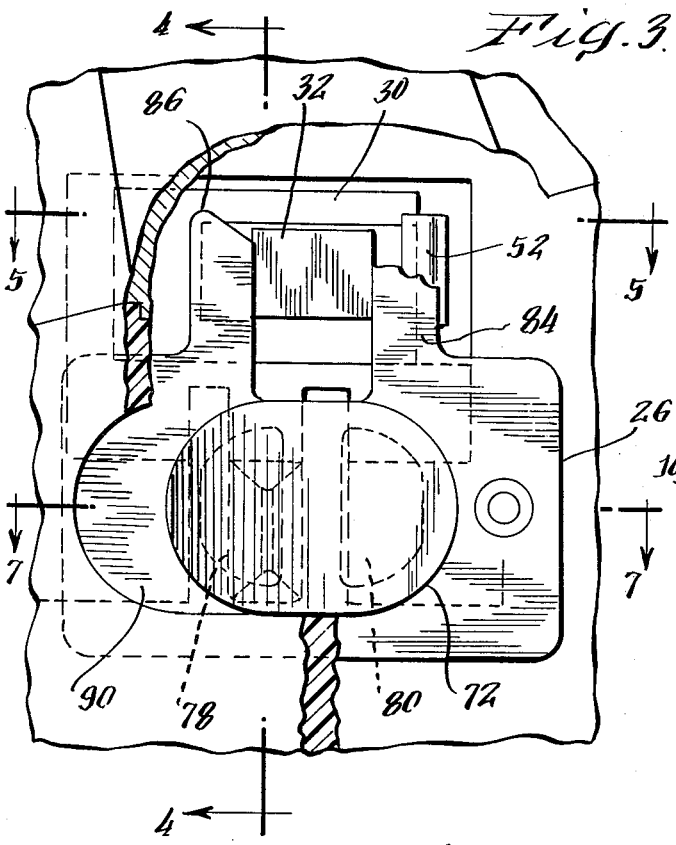
FIG. 3 is an enlarged, fragmentary, partly cut away side elevation view of the shaver of FIG. 1, which illustrates an embodiment of a switch arrangement constructed in accordance with features of this invention.

Referring now to the drawings, a portable hand held electric appliance is shown to comprise an electric dry shaver which includes a casing, indicated generally by reference numeral 20, and a cutter head supported by the casing and indicated generally by reference numeral 22. There is included in the shaver, but not illustrated for purpose of clarity in the drawings, a cutter blade assembly and an electric motor. The cutter blade assembly is positioned in the cutter head 22 while the electric motor is mounted within a lower part of the casing 20. When actuated, the cutter blade assembly cooperates with an outer cutter surface 24 to cut facial hairs. The motor and thus the cutter is actuated by the tactile movement of a detent body which is indicated generally in FIG. 1 by reference numeral 26. Detent body 26 is a component of an electric switch arrangement and the present invention is directed to the mechanical aspects of this switch arrangement.

As illustrated in FIG. 2, an electric switch is shown to comprise a generally rectangular shaped body 30 having an actuating member 32 extending from a window shaped slot 34 which is formed in the switch body. The switch is a two position slide switch which is actuated between On/Off positions by laterally sliding the member 32 between extreme positions of the slot 34.

Figure 4:
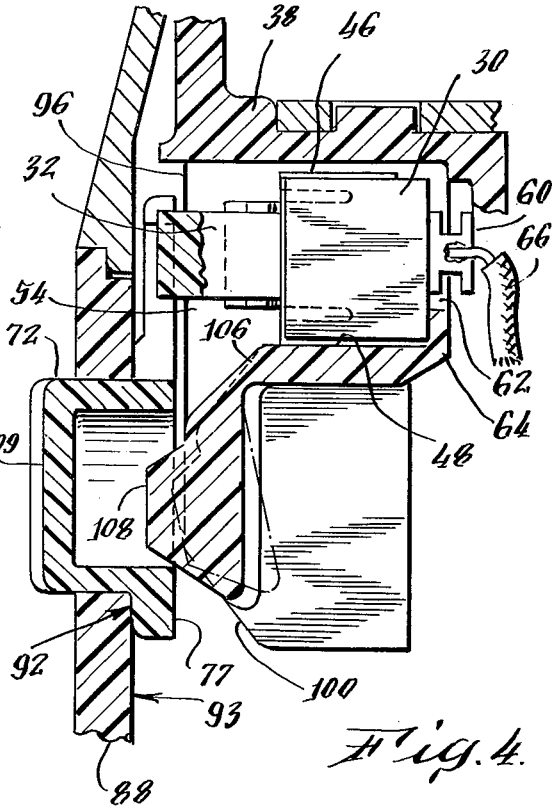
FIG. 4 is a fragmentary sectional view taken along lines 4—4 of FIG. 3.
Figure 5:
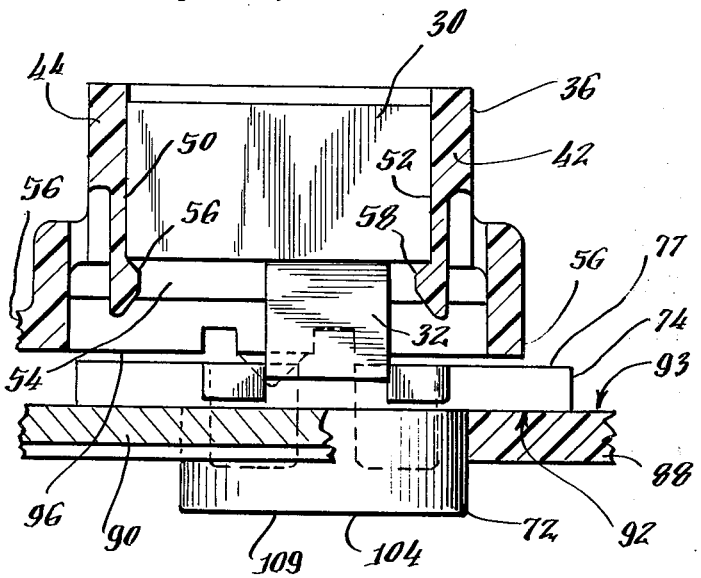
FIG. 5 is a fragmentary sectional view taken along lines 5—5 of FIG. 3.

A means for supporting the switch body 30 within the shaver comprises a receptacle 36 which is integrally formed in a second body 38. The second body 38 is a shroud which is positioned between a frame member 40 of the cutter head 22 and a lower portion of the casing 20 and is provided for inhibiting the passage of cut hair particles into the lower casing where they would accumulate and eventually interfere with the proper operation of the electric motor. Frame member 40 is secured to the shroud 38 by screw means 42 and shroud 38 is mechanically coupled through drive reaction arms, not illustrated, to the electric motor. The shroud 38 is of single piece construction and the receptacle 36 is integrally formed as illustrated in FIGS. 4 and 5 by side wall segments 42 and 44, a surface segment 46 of the shroud, and a lower surface segment 48. The switch body 30 is positioned within the receptacle 36 and is captivated therein by means comprising a pair of integrally formed resilient fingers 50 and 52 (FIG. 5). During assembly, the switch body 30 is introduced into the receptacle through an aperture, indicated generally by reference numeral 54, which is formed in a side wall segment 56 of the shroud. During insertion of the switch 30 into the receptacle 36, the switch 30 initially contacts the resilient fingers 50 and 52 which are forced apart by the switch body thereby enlarging the entry and permitting the switch to advance toward a rearward position of the receptacle 36. The deflected resilient fingers 50 and 52 include re-entrant portions 56 and 58 respectively which engage and captivate the switch in the receptacle. As illustrated in FIG. 4, the switch 30 includes terminal lug means 60 which extend through an aperture, indicated generally by reference numeral 62, in a rear wall segment 64 of the receptacle 36 and provides access for an electrical connection to a lead means 66. This lead means is coupled between the switch body 30, a source of operating potential and the electric drive means for enabling or interrupting the application of electric power to the electric drive means.

Figure 6:
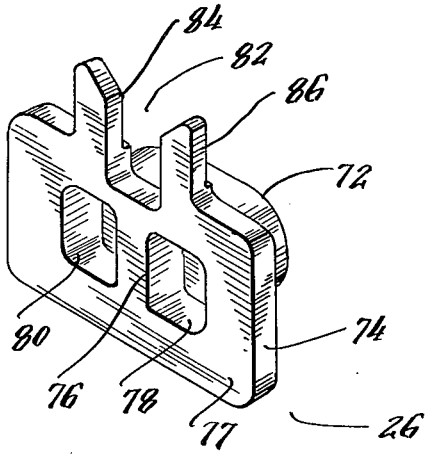
FIG. 6 is a perspective view of a detent body utilized with the switch arrangement of FIG. 3.

It is desirable during operation of the switch that the user be provided with an affirmative "feel" indicating that the actuating member 32 has transferred between the On/Off positions. For reliability of operation, it is also desirable that the position of the actuating member 32 and thus the position of switch contacts within the switch body 30 be firmly established by a positive detenting mechanism. In accordance with a feature of the invention, a positive detenting arrangement for the switch includes the detent body 26. As illustrated in FIG. 6, the detent body 26 is generally hat shaped and includes a crown segment 72 and a rim segment 74. An integral rib 76 is formed in a surface 77 of the body opposite the crown segment 72. This rib defines apertures 78 and 80 within the crown 72 of the body. A means comprising a fork shaped projection indicated generally by reference numeral 82, is provided for enabling the switch actuating member 32. The projection 82 extends from the rim 74 and includes tong members 84 and 86. These tong members are spaced apart by a distance for snugly receiving the switch actuating member 32, as illustrated in FIG. 3.

The shaver casing 20 includes an integral wall member 88 having a slotted aperture 90 formed therein. The aperture 90 is adapted to receive the crown segment 72 of the detent body 26 and has a width slightly larger than the width of the crown 72 while the length of the aperture 90 is greater than the length of the crown by an amount for permitting sliding motion of the crown within the aperture and a path of travel for the detent body is thus defined by the slotted aperture 90. The slotted aperture 90 has a length which enables the crown 72 to travel a distance in the slot 90 substantially equal to a lateral distance traveled by the actuating member 32 between extreme positions of switch body slot 34. As illustrated in FIGS. 4 and 5, the crown segment 72 is positioned within the slotted aperture 90 while a surface 92 of the rim segment 74 is positioned in sliding engagement with an inner surface 93 of the wall segment 88 and restrains the detent member 26 within the casing. The opposite surface 77 of the rim segment 74 is positioned adjacent a surface 96 (FIG. 2) of the shroud wall segment 56 and makes sliding engagement with this surface.

A resilient means is positioned within the shaver is the path of travel of the detent body which interferes with the travel of the detent body. The sliding motion of the detent body is interferred with by a resilient segment 100 of the shroud wall 56. The segment 100 comprises a tab (FIG. 2) which is formed in the wall segment 56 by slots 102 and 104 (FIG. 7). The slots extend to a lower edge of the wall 52 thereby providing for support of the tab 100 at one end 106 thereof. Tab 100 is centrally located with respect to the aperture 90 and includes a tapered projection 108 which extends toward the aperture 90 from the surface 56. The projection 108 will therefore interfere with the movement of a body along the surface 96 of the shroud wall 56.

In the assembled configuration as illustrated in FIGS. 3, 4, and 5, the crown segment 72 extends through the aperture 90 of the casing member 88; the surface 92 of the detent body is positioned in sliding contact with the inner surface 93 of the wall member 88; the surface 77 of the detent body 26 is positioned adjacent to and in contact with the surface 96 of the shroud wall 56; and the fork shaped segment 82 of the detent body straddles and engages the actuating member 32 of the switch body 30. When the switch actuating member 32 is in a first detented position, the projection 108 of the tab 100 will extend into one of the apertures 78, 80 of the detent body while when the actuating member 34 is in a second detented position, it will extend into the other aperture. Tactile actuation of the detent body by the application of finger pressure to a surface 109 of the crown segment 72 causes the body 26 to slide within the aperture against the restraining force of the tab 100. In FIG. 7, the tab 100 is shown seated in the recess 78 and the switch actuating member 32 is securely detented in a first position by the restraining force of the detenting segment 100 against one side of 110 of the rib 76. In FIG. 8, the detent body is shown located along its course of travel to the second detenting position. The detent segment 100 has been forced to a retracted position through contact with the rib 76 as a result of a tactile force applied to the surface 109. The continued application of the tactile force will cause the detent body 26 to continue to travel to the left and the detent tab 100 will engage the recess 80 and establish a positive restraining force against another side 114 of the rib 76. During this travel, the tongs 84 and 86 cause the switch actuating member 32 to be transported therewith to a second operative switch position.

In providing for the resilient characteristics of the detent segment 100, the shroud 38 is formed of a material which enables deflection of this segment and restoration of the segment to a home position after deflection. The shroud is preferably formed of a thermoplastic resin such as an acetal homopolymor. One such commercially available material comprises DELRIN 500, a product of the DuPont Corporation of Wilmington, Delaware.

The detenting arrangement thus described is advantageous in that it provides for a definitive "feel" for the user in transferring the switch between the On/Off positions and establishes a positive mechanical detent for the switch. The cost factor in providing the switch 30 is thus reduced since the detent arrangement described herein is adapted to supplement or replace the detent function which is found in such switches. In addition, the switch mounting arrangement described is advantageous in that it is adapted for receiving and securing the switch body 30 without the use of additional parts, members or elements or without the performance of additional assembly operations, since the receptacle 36 is integrally formed with the single piece shroud 38.

There has thus been described an improved switch mounting arrangement and a switch detenting enhancement or, alternatively a switch detent substitute arrangement which advantageously provide for an inexpensive and positive detenting function for an On/-Off switch in a hand held, portable electrical appliance.

While there has been described a particular embodiment of the invention, it will become apparent to those skilled in the art that variations may be made thereto without departing from the spirit of the invention and the scope of the appended claims.

We claim:

1. An improved electric switch detent arrangement for a hand-held portable electrical appliance having a casing with an aperture comprising, a. an electric switch unit having a detentless actuating member for operating the switch in on/off positions, b. means provided in the appliance casing for supporting said switch unit, c. a movable detent member within the appliance casing having a portion extending through said casing aperture and supported for movement along a path of travel defined by the casing aperture, d. means formed on said detent member for operatively engaging said switch actuating member, and e. resilient means within the appliance casing positioned in said path of travel and deflectable by the movable detent member upon operation thereof for detenting the switch actuating member into either of said on/off positions.

2. The switch detent arrangement of claim 1 wherein said resilient means include a tab formed from a wall segment of said support means.

3. The switch detent arrangement of claim 2 wherein said tab is part of said wall segment and formed by a pair of slots in the wall segment, said slots extending to a distal edge of the wall segment.

4. The switch detent arrangement of claim 1 wherein said detent member compirses a hat-shaped body having rim and crown portions formed thereon.

5. The switch detent arrangement of claim 4 wherein said detent member engaging means comprise a forked-shaped portion formed on said rim portion.

6. The switch detent arrangement of claim 4 wherein said crown portion comprises said detent member extending portion.

7. The switch detent arrangement of claim 4 wherein said crown portion includes a rib formed therein and positioned for engagement with said tab, said rib deflecting the tab upon said operation of the detent member.

8. The switch detent arrangement of claim 1 wherein said switch unit supporting means in said casing include a receptacle having resilient members formed thereon for receiving and restraining the switch unit within the receptacle.

9. The switch detent arrangement of claim 8 wherein said receptacle extends from adjacent said casing aperture to the interior of said casing, said switch unit being positioned in the receptacle with said switch actuating member extending from the switch unit toward the casing aperture for engagement by said detent member.

10. An improved electric switch detenting arrangement for an electric dry shaver comprising, a. a shaver casing having an aperture formed therein, b. a cutter head supported by said casing, c. a shroud member positioned between the casing and said cutter head for inhibiting passage of hair particles into the casing, d. a movable detent member having a portion extending through said casing aperture and supported for movement along a path of travel defined by the casing aperture, e. an electric switch unit having a detentless actuating member for operating said switch in on/off positions, f. means formed from said shroud member for supporting said switch unit including a receptacle having resilient members formed thereon for receiving and interlocking the switch unit within said receptacle, g. means formed from said detent member operatively engaging said switch actuating member, and h. resilient means formed on the shroud member positioned in said path of travel and deflectable by the movable detent member upon operation thereof for detenting the switch actuating member into either of said on/off positions.

* * * * *